US005653284A

United States Patent [19]

Giammaruti et al.

[11] Patent Number: 5,653,284

[45] Date of Patent: Aug. 5, 1997

[54] HEAT PIPE HEAT EXCHANGER TUBESHEET

[75] Inventors: Robert Joseph Giammaruti, North Canton, Ohio; James Milton Mazel; Darrell Wayne Zahn, both of Wharton, Tex.

[73] Assignee: Hudson Products Corporation, Houston, Tex.

[21] Appl. No.: 560,750

[22] Filed: Nov. 21, 1995

[51] Int. Cl.[6] ..... F28F 9/00

[52] U.S. Cl. ..... 165/162; 165/178; 165/DIG. 51; 165/DIG. 401; 165/104.14; 285/192

[58] Field of Search ..... 165/178, 162, 165/158, 104.14, DIG. 401, DIG. 52, DIG. 51; 285/917, 192

[56] References Cited

U.S. PATENT DOCUMENTS

| | | | |
|---|---|---|---|
| 1,837,442 | 12/1931 | Jackson | 165/162 |
| 1,992,504 | 2/1935 | Penniman | 165/162 |
| 2,404,539 | 7/1946 | Schmidt | 285/192 X |
| 2,862,693 | 12/1958 | Tinker | 165/162 |
| 3,572,770 | 3/1971 | Kagi | 165/162 X |
| 4,433,860 | 2/1984 | Lindquist | 285/192 |
| 4,738,310 | 4/1988 | Luttenberger et al. | 165/162 X |
| 4,768,585 | 9/1988 | Hayes et al. | 165/162 |
| 5,085,270 | 2/1992 | Counterman et al. | 165/104.14 X |
| 5,086,831 | 2/1992 | Paikert et al. | 165/104.14 X |
| 5,505,499 | 4/1996 | Wallbank | 285/192 X |

FOREIGN PATENT DOCUMENTS

| | | | |
|---|---|---|---|
| 207802 | 9/1955 | Australia | 165/178 |
| 448866 | 6/1948 | Canada | 165/162 |
| 0134596 | 6/1986 | Japan | 165/162 |
| 62676 | 3/1949 | Netherlands | 165/178 |
| 480574 | 2/1938 | United Kingdom | 165/162 |
| 661934 | 11/1951 | United Kingdom | 165/178 |

*Primary Examiner*—John Rivell
*Assistant Examiner*—Christopher Atkinson
*Attorney, Agent, or Firm*—Robert J. Edwards; Michael L. Hoelter

[57] ABSTRACT

A method and apparatus for separately supporting and sealing a heat pipe within a heat exchanger. For support, the heat pipe with fins thereon passes through a support grid which consists of a series of rings secured or interconnected together. The fins of the heat pipe rest upon these rings of the support grid thereby supporting this region of the heat pipe. To seal these heat pipes in order to prevent any gas escape from the heat exchanger, a tubesheet with openings therein is placed over the ends of the heat pipe. These openings are oversized thus a considerable gap exists between the tubesheet and the heat pipe. This gap is covered or sealed by use of a cover disk which tightly fits around the heat pipe and spans across this gap before it is removably secured to the tubesheet. By this fashion, once the cover disk is removed from the tubesheet, it is a relatively easy task to then remove the tubesheet and the heat pipe from the heat exchanger for maintenance or repair purposes.

14 Claims, 5 Drawing Sheets

HEAT PIPE HEAT EXCHANGER TUBESHEET

FIELD OF THE INVENTION

This invention pertains to the tubesheet found in heat pipe heat exchangers and more particularly to a new design for such a tubesheet that permits easier removal of the heat pipe from the heat exchanger.

BACKGROUND OF THE INVENTION

Heat pipe heat exchangers generally consist of two separated flow channels (one for cold air and the other for hot gas) across which multiple rows of heat pipe extend. These various heat pipes contain the heat exchange medium (often water) that enables a heat exchange between these separate flow streams.

To maintain the separation of the flow streams, a divider plate is generally installed in the middle region of the heat exchanger with a tubesheet placed around the opposite ends of the elongated heat pipe. Such a tubesheet often serves a dual function of both supporting the heat pipe and sealing the flow channel. Otherwise, air or gas may by-pass the heat transfer surface thereby reducing its efficiency.

Typical tubesheets often consist of a flat plate, usually metal, having a series of holes or openings therein. These openings are generally sized slightly larger than the diameter of the heat pipe so that a wear sleeve can be installed around the heat pipe before being welded to the heat pipe.

Unfortunately, should a heat pipe need to be removed for any reason, the tubesheet must first be removed so that access to the heat pipe can be achieved. Such removal is extremely difficult if the heat exchanger has been in service for any extended period of time due to corrosion and the like. Also, the small tubesheet clearance provided by the wear sleeve is not of significant assistance.

Generally, the area of the tubesheet around the heat pipe must be physically cut, such as by a torch, before the heat pipe can be removed. This necessitates either the recycling of the cut tubesheet plug or the manufacture of a new one which must be installed after the heat pipe is replaced or re-installed. Such an operation increases the cost of working on or repairing heat pipe both in the field and in the shop.

It is thus an object of this invention to provide a new design for a tubesheet that enables easy removal of heat pipe without the need to physically cut or otherwise damage the tubesheet. Another object of this invention is to provide a means of sealing the tubesheet against the heat pipe with such seals being removable when the heat pipe is to be removed. Still another object of this invention is to provide a means of supporting the ends of the heat pipe separate from the sealing assembly. These and other objects and advantages of this invention will become obvious upon further investigation.

SUMMARY OF THE INVENTION

This invention pertains to a heat exchanger tubesheet design that consists of a support assembly used to support heat pipe within a heat exchanger. A separate tubesheet is positioned adjacent this support assembly with this tubesheet having a plurality of openings therein that are sized larger than the diameter of the heat pipe passing therethrough. Each of these openings are oversized thereby defining a gap between its respective heat pipe and the tubesheet. To seal the heat pipe within its respective opening in the tubesheet, a sealing assembly is installed which spans and thereby closes this gap. This sealing assembly is then secured across this gap to the tubesheet.

DETAILED DESCRIPTION OF THE PREFERRED EMBODIMENTS

Figure 1:
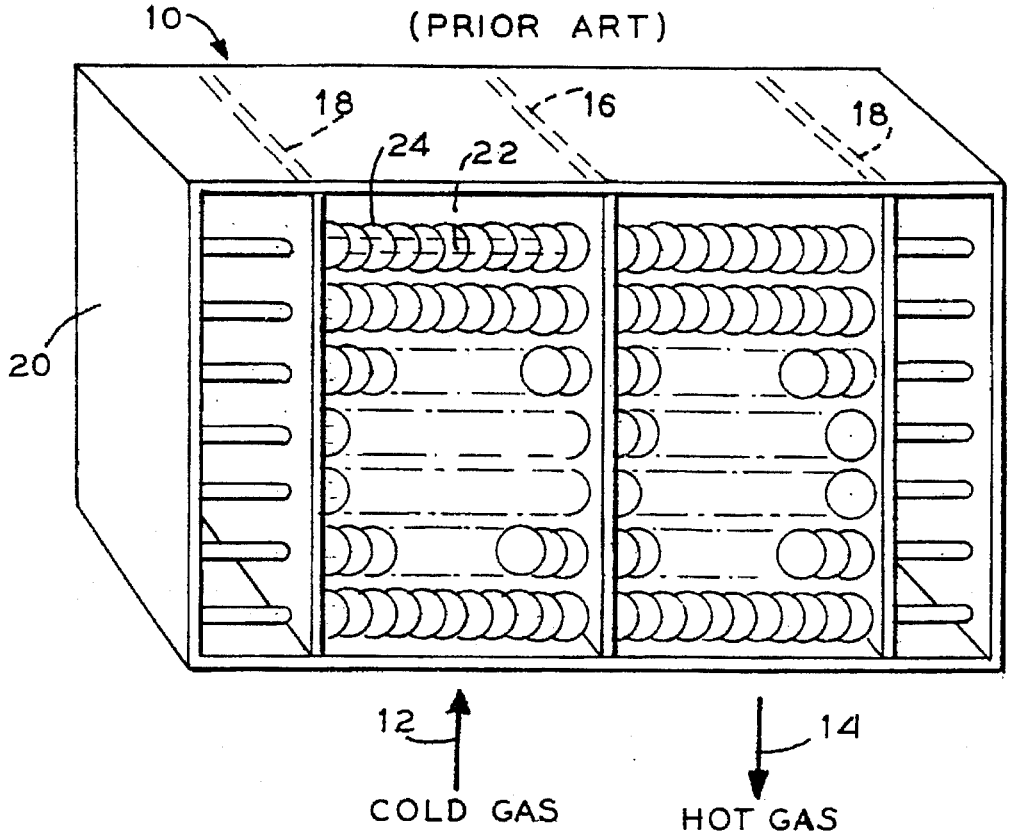
FIG. 1 (PRIOR ART)
FIG. 1 is a pictorial view of a typical heat pipe heat exchanger illustrating the various flows therethrough.

Referring initially to FIG. 1, there is shown typical heat pipe heat exchanger 10 illustrating the flow of cold gas 12 (generally air) and hot gas 14 (generally a flue gas) therethrough. A divider plate 16 in a middle region of heat exchanger 10 separates these flow streams 12 and 14. Adjacent the opposite sides of heat exchanger 10 are tubesheets 18 which, along with housing 20 of heat exchanger 10, complete the enclosure of flow streams 12 and 14. Extending through each such flow enclosure (and hence divider plate 16 and tubesheets 18) are a plurality of capped heat pipe 22. Each heat pipe 22 has a multitude of fins 24 secured to its outer perimeter for greater heat exchange with gases 12 and 14. The purpose of heat exchanger 10 is to permit a heat exchange between gases 12 and 14 without any intermixing of such gases. Such heat exchange is accomplished by an exchange medium (usually water) contained within each heat pipe 22.

Figure 2:
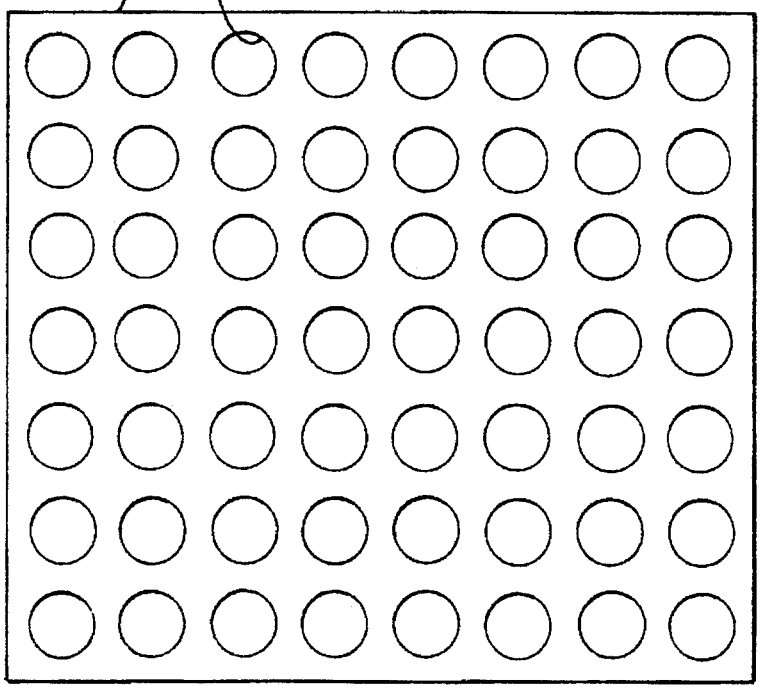
FIG. 2 (PRIOR ART)
FIG. 2 is a pictorial view of a typical tubesheet for such a heat pipe heat exchanger.

Referring now to FIG. 2, there is shown typical tubesheet 18 configured with a series of openings 26 therein. It is through these openings 26 that heat pipe 22 extend. Consequently, these openings 26 are arranged so as to maximize the benefit of the placement of heat pipe 22 within heat exchanger 10. However, openings 26 are sized smaller than fins 24 such that heat pipe 22 is not able to be simply pulled through tubesheet 18.

Figure 3:
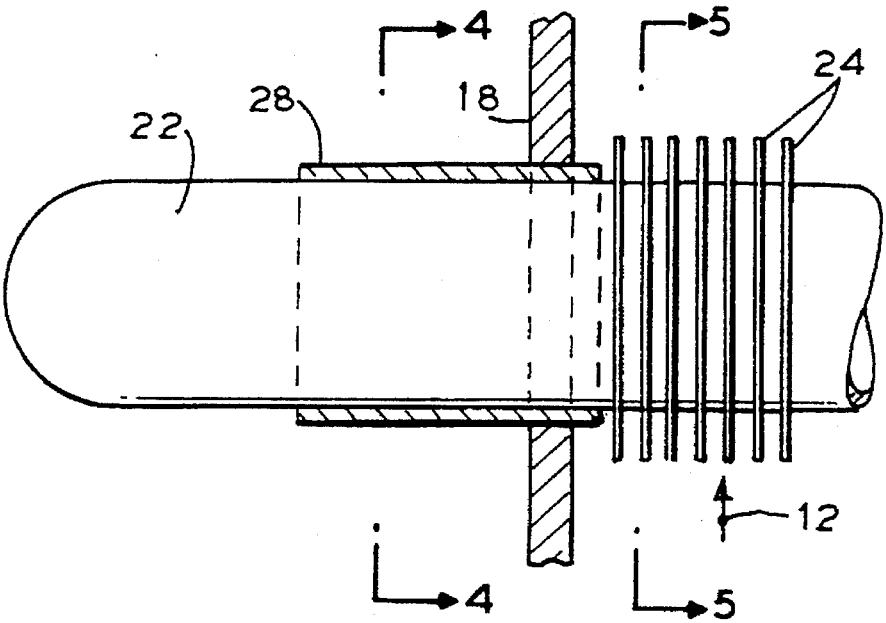
FIG.3 (PRIOR ART)
FIG. 3 is a pictorial view of the typical manner of securing a heat pipe to the tubesheet of FIG. 2.
Figure 4:
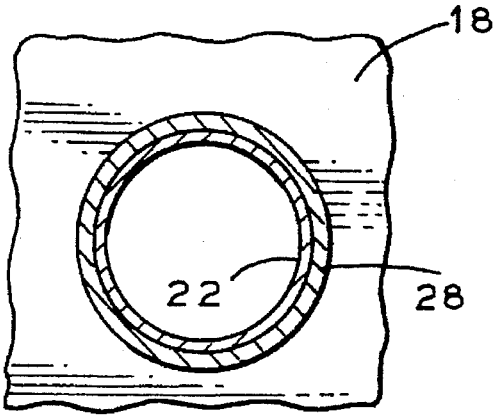
FIG.4 (PRIOR ART)
FIG. 4 is a sectional view, partially cut away, taken along lines 4—4 of FIG. 3.
Figure 5:
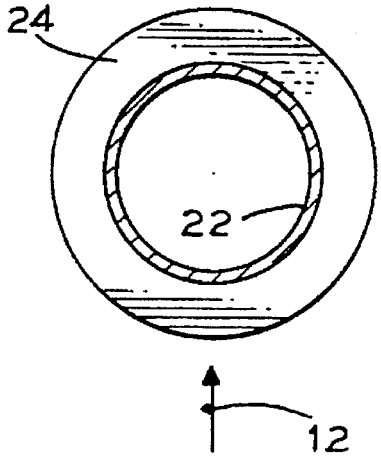
FIG.5 (PRIOR ART)
FIG. 5 s a sectional view, partially cut away, taken along lines 5—5 of FIG. 3.

FIGS. 3–5 illustrate the conventional or typical manner of installing heat pipe 22 through tubesheet 18. As shown, wear sleeve 28 is generally tack welded to heat pipe 22 over the region of heat pipe 22 that is to engage tubesheet 18. Wear sleeve 28 is preferably not also welded to tubesheet 18, but instead is allowed to slip or thermally expand and/or contract (along with heat pipe 22) with respect to tube sheet 18. This wear sleeve 28 is employed as a wear protector in order to prevent any thinning of heat pipe 22 at this connection, such as by the thermal expansion or contraction of heat pipe 22. Since wear sleeve 28 is typically welded to heat pipe 22 which is then placed through tubesheet 18, such an arrangement not only provides end support directly to heat pipe 22, but this connection also seals gases 12 and 14 within their respective enclosures. Structural support is provided by tubesheet 18 and the subsequent securement of tubesheet 18 to heat exchanger 10. The gas seal is achieved by the tight fit of wear sleeve 28 through tubesheet 18. Because of the need for such a tight fit, opening 26 cannot be sized much larger than the outer diameter of wear sleeve 28 otherwise leakage of cold gas 12 or hot gas 14 would occur. Consequently, these openings 26 must be sized smaller than fins 24 which thereby prevents heat pipe 22 from simply being pulled out through opening 26. Thus, once installed in this manner, before a heat pipe 22 can be removed from heat exchanger 10, tubesheet 18 must be cut or removed such as by a torch or saw or the like. Such removal of heat pipe 22 is often necessary for repair and/or inspection purposes.

FIGS. 6 through 15 illustrate the invention which is an improvement to the method and apparatus currently used to seal and support heat pipe 22 in heat exchanger 10. As shown, the steps of sealing and supporting heat pipe 22 are not combined as in the typical method, but instead are accomplished by separate adjacent structure (although the sealing structure may also provide some support to heat pipe 22).

Figure 6:
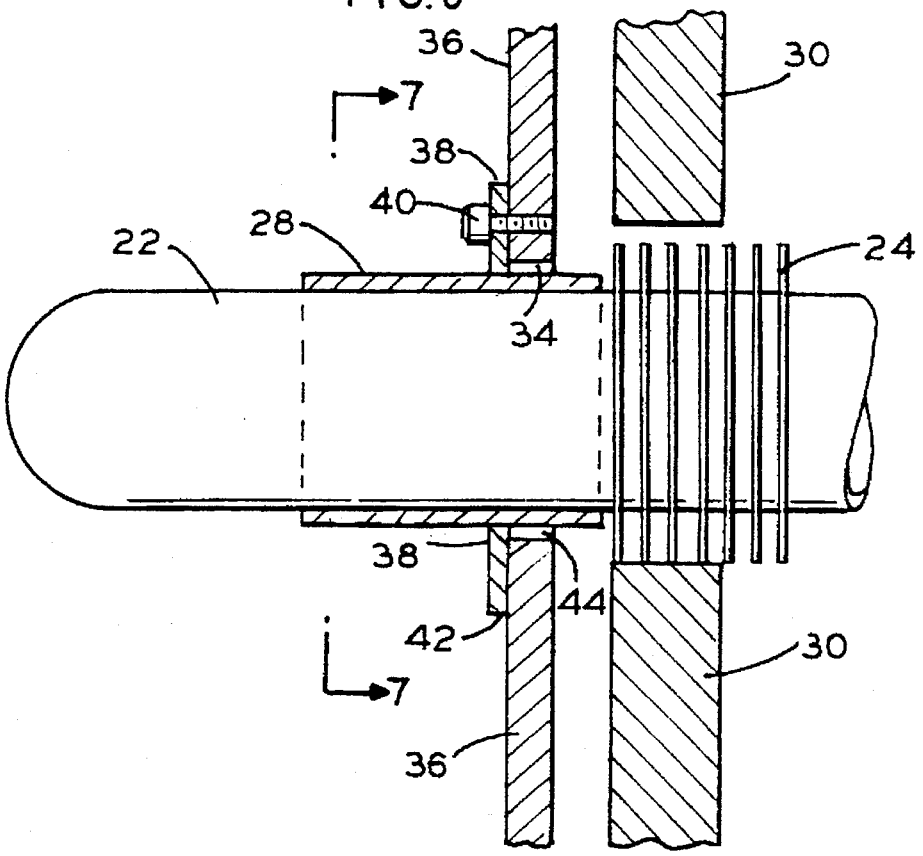
FIG. 6 is a pictorial view of the new manner of securing a heat pipe to a tubesheet as disclosed herein.
Figure 7:
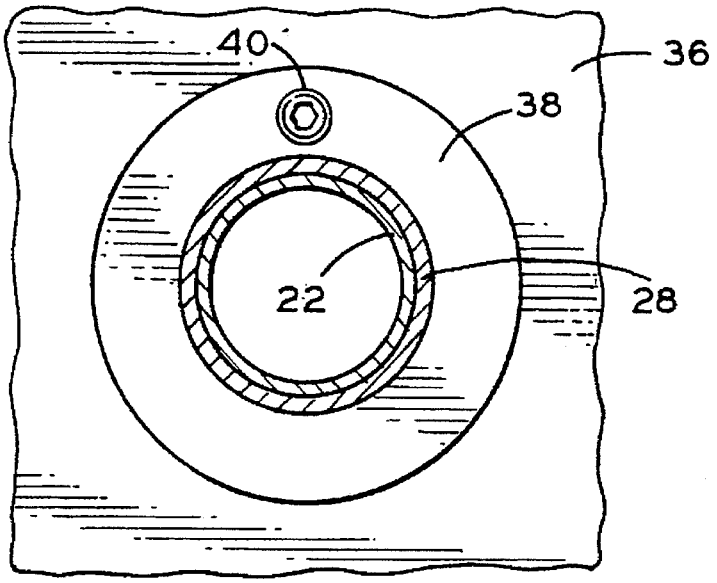
FIG. 7 is a sectional view, partially cut away, taken along lines 7—7 of FIG. 6 illustrating the new manner disclosed herein of removably sealing a heat pipe to a tubesheet.
Figure 8:
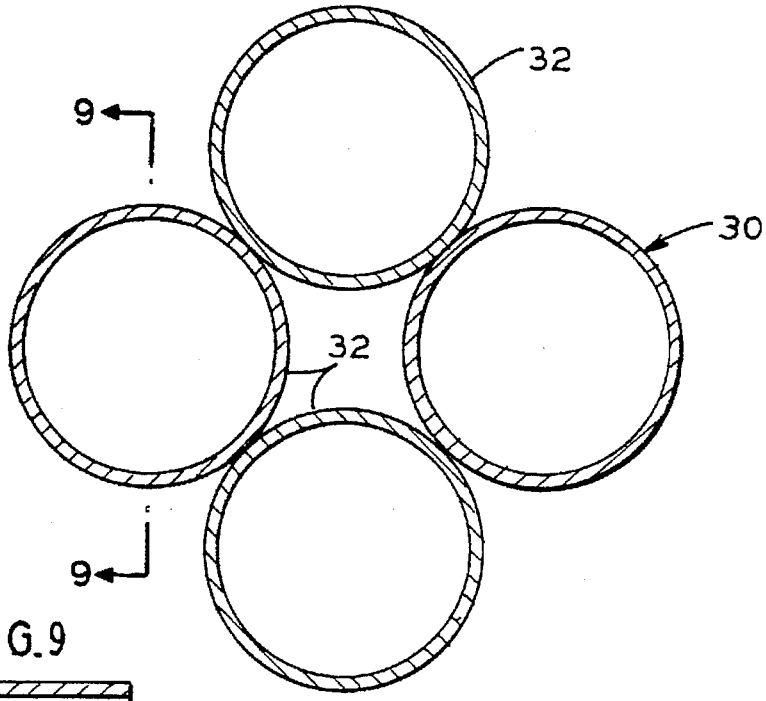
FIG. 8 is a pictorial view of the new manner of supporting the heat pipe adjacent the tubesheet.
Figure 9:
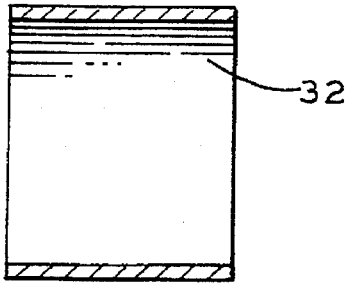
FIG. 9 is a sectional view taken along lines 9—9 of FIG. 8.
Figure 10:
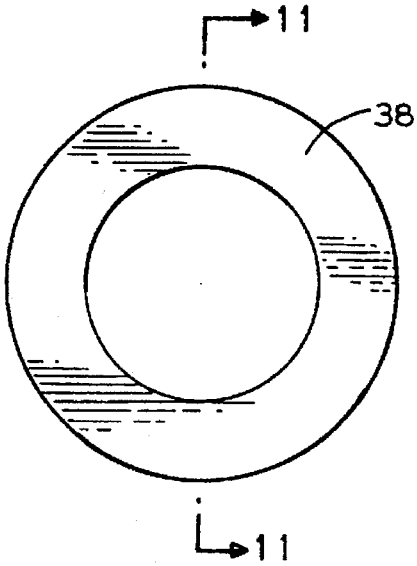
FIG. 10 is a front pictorial view of the cover disc used to removably seal the heat pipe with respect to the tubesheet.
Figure 11:
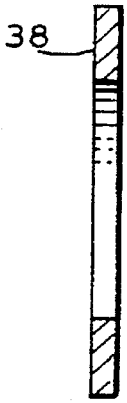
FIG. 11 is a sectional view taken along lines 11—11 of FIG. 10.
Figure 12:
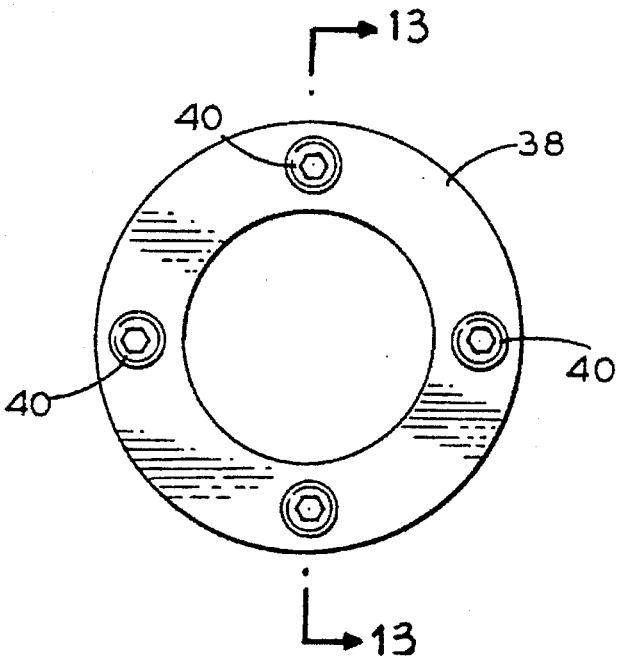
FIG. 12 is a front pictorial view of an alternate cover disc which may be used to removably seal the heat pipe with respect to the tubesheet.
Figure 13:
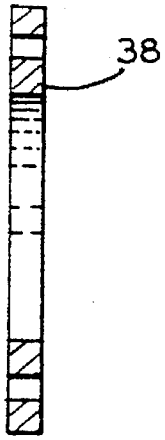
FIG. 13 is a sectional view taken along lines 13—13 of FIG. 12.

Support of heat pipe 22 is accomplished by support grid 30 which generally consist of a series of rings 32 that are welded or otherwise secured or connected together. FIG. 8 discloses one arrangement of rings 32 to form support grid 30 while FIG. 9 discloses a typical configuration of each such ring 32. As shown in FIG. 6, the fins 24 of each heat pipe 22 will engage and rest upon the inside diameter of rings 32 thereby providing support to this portion of heat pipe 22. This manner of support is also able to accommodate any thermal expansion or contraction that may occur between heat pipe 22 and ring 32. Obviously, the actual arrangement of rings 32 in support grid 30 must coincide with openings 34 in tubesheet 36.

The sealing of heat pipe 22 so as to prevent any gas from escaping its enclosure is accomplished by annular sealing or cover disks 38 as shown in FIGS. 10–13. These annular disks 38 are sized to slip over the end of each heat pipe 22 before being secured to tube sheet 36. These disks 38 can be secured in place either by screws 40, by high-temperature silicone sealant 42, or by some other such method. This method of securement allows for thermal expansion or slip between heat pipe 22 and disk 38. In any event, the inside diameter of each disk 38 is sized slightly larger than heat pipe 22 (or its respective wear sleeve 28) so as to act as a flow barrier to gases 12 and 14 passing through heat exchanger 10. The outside diameter of each disk 38 is sized greater than openings 34 so as to cover them.

These opening 34 can now be over-sized thereby including or incorporating a gap 44 between opening 34 and heat pipe 22 (or wear sleeve 28) since this gap 44 will now be covered or closed by disk 38. Consequently, once this disk 38 is removed (such action being relatively easily accomplished), the heat pipe 22 will no longer be physically secured to tube sheet 36 thereby making its removal from heat exchanger 10 easier. Also, since heat pipe 22 is now supported by resting its fins 24 within rings 32, this manner of support will also pose no additional difficulty to the removal of heat pipe 22.

Figure 14:
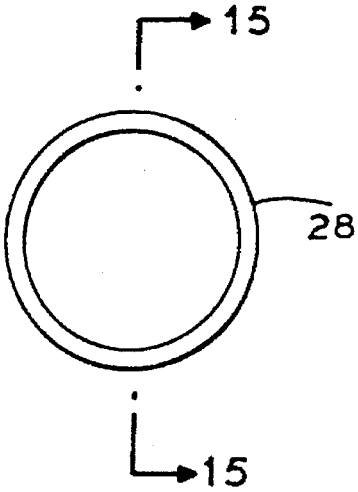
FIG. 14 is a front pictorial view of the wear sleeve often placed intermediate the heat tube and the tubesheet.
Figure 15:
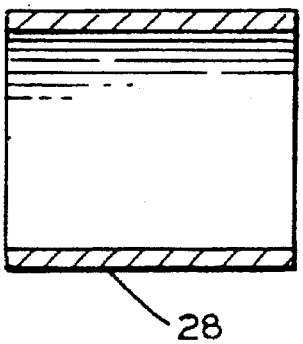
FIG. 15 is a sectional view taken along lines 15—15 of FIG. 14.

FIGS. 14 and 15 disclose a typical wear sleeve 28 which is placed over the region of the heat pipe 22 that will engage disk 38. This wear sleeve 28 prevents any thinning of the heat pipe 22 at this location due to any metal-to-metal erosion or movement between heat pipe 22 and disk 38.

This new tubesheet 36 with oversized openings 34 therein can be installed in the typical manner such as by bolting it into the perimeter of housing 20. Cover disk 38 would then be placed over the end region of heat pipe 22 to seal this heat pipe 22 in place. Afterwards, if it is ascertained that only a section of the heat pipe bundle must be removed, tubesheet 36 can be sectioned or cut in the normal manner so as to remove only the affected portion. The separation of tubesheet 36 from the heat pipe 22 is now relatively easily accomplished since it now only requires the removal of cover disk 38 from around each affected heat pipe 22. Once tubesheet 36 is removed, heat pipe 22 can likewise be easily removed by simply lifting it from its resting place upon ring 32.

Some of the advantages of this invention include a simple, flexible and inexpensive method of installing heat pipe 22 within a heat exchanger 10. This invention also provides a simple and inexpensive method of removing such heat pipe 22 in the field should conditions ever warrant such removal. Also, while the above was described with respect to the cold side of heat exchanger 10, such a tubesheet 36 and method of installation can be applied to the hot side as well. Furthermore, in lieu of cover disks 38, a second more typical tubesheet 18 (i.e. one with tightly fitting openings 26 therein) which has been sectioned into several pieces can be placed over the tubesheet 36 of this invention. This sectioned typical tubesheet 18 can be secured to larger tubesheet 36 by simple fasteners or via silicone sealant. In this fashion, more than one gap 44 between the heat pipe 22 and openings 34 in tubesheet 36 can be sealed at a time.

What is claimed is:

1. A heat exchanger tubesheet design comprising:

(a) support means for supporting heat pipe therein, said support means comprising a plurality of rings secured together, each with a heat pipe passing therethrough, each heat pipe being supported by one of said rings;

(b) a separate tubesheet adjacent said support means, said tubesheet having a plurality of openings therein sized larger than the diameter of the heat pipe passing therethrough, each said opening defining a gap between its respective heat pipe and said tubesheet;

(c) sealing means for sealing the heat pipe within its respective opening in said tubesheet, said sealing means spanning said gap; and, (d) means for securing said sealing means across said gap and to said tubesheet.

2. The apparatus as set forth in claim 1 wherein said sealing means is removably secured to said tubesheet.

3. The apparatus as set forth in claim 2 wherein said sealing means comprise an annular disk sealably secured to said tubesheet.

4. The apparatus as set forth in claim 3 wherein each heat pipe has fins thereon and wherein said rings have a diameter larger than the outer diameter of any fin secured to the heat pipe passing therethrough.

5. The apparatus as set forth in claim 4 wherein one or more fins of the heat pipe extend within and rest upon its respective said ring.

6. The apparatus as set forth in claim 5 further comprising a wear sleeve positioned around the heat pipe at its juncture with said sealing means.

7. The apparatus as set forth in claim 5 wherein said annular disk is threadably secured to said tubesheet.

8. A method of supporting and sealing a heat pipe within a heat exchanger comprising the steps of:

(a) supporting heat pipe within the heat exchanger via a support assembly;

(b) positioning a separate tubesheet adjacent said support assembly, said tubesheet having a plurality of openings therein sized larger than the diameter of the heat pipe passing therethrough, each said opening defining a gap between its respective heat pipe and said tubesheet;

(c) sealing the heat pipe within its respective opening in said tubesheet via a sealing assembly, said sealing assembly spanning said gap;

(d) securing said sealing means across said gap and to said tubesheet;

(e) passing the heat pipe through said support assembly, said support assembly comprising a plurality of rings secured together.

9. The method as set forth in claim 8 further comprising the step of removably securing said sealing assembly to said tubesheet.

10. The method as set forth in claim 9 further comprising the step of constructing and arranging said sealing assembly as an annular disk which is sealably secured to said tubesheet.

11. The method as set forth in claim 9 further comprising the step of constructing and arranging said rings with a diameter larger than the outer diameter of any fin secured to the heat pipe passing therethrough.

12. The method as set forth in claim 11 further comprising the step of arranging one or more fins of the heat pipe to extend within and rest upon its respective said ring.

13. The method as set forth in claim 12 further comprising the step of positioning a wear sleeve around the heat pipe at its juncture with said sealing assembly.

14. The method as set forth in claim 12 further comprising the step of threadably securing said annular disk to said tubesheet.

* * * * *